US005988635A

United States Patent [19]

Ohshima

[11] Patent Number: 5,988,635

[45] Date of Patent: Nov. 23, 1999

[54] SHEET TRANSPORTING DEVICE

[75] Inventor: Keiichi Ohshima, Nagano, Japan

[73] Assignee: Seiko Epson Corporation, Tokyo, Japan

[21] Appl. No.: 08/955,824

[22] Filed: Oct. 22, 1997

[30] Foreign Application Priority Data

Oct. 22, 1996 [JP] Japan ..... 8-298042

[51] Int. Cl.[6] ..... B65H 5/06

[52] U.S. Cl. ..... 271/274; 271/109

[58] Field of Search ..... 271/109, 272–274; 492/49, 53

[56] References Cited

U.S. PATENT DOCUMENTS

| | | | |
|---|---|---|---|
| 4,780,746 | 10/1988 | Naramore et al. | 271/274 |
| 5,246,224 | 9/1993 | Matsuno et al. | 271/242 |
| 5,320,042 | 6/1994 | Schwöpfinger | 492/53 |
| 5,540,427 | 7/1996 | Nitta et al. | 271/274 |
| 5,553,845 | 9/1996 | Sawa et al. | 271/272 |

FOREIGN PATENT DOCUMENTS

| | | |
|---|---|---|
| 2027092 | 9/1970 | France . |
| 60-258050 | 12/1985 | Japan . |
| 4-140247 | 5/1992 | Japan . |
| 9-175703 | 7/1997 | Japan . |

OTHER PUBLICATIONS

Edwards et al, Variable Force for Thrust and Idler Rollers, IBM Technical Disclosure Bulletin, vol. 23, No. 6 pp. 2228–2229 Nov. 1980.

*Primary Examiner*—H. Grant Skaggs
*Attorney, Agent, or Firm*—Stroock & Stroock & Lavan LLP

[57] ABSTRACT

A sheet transporting device includes a drive roller including a high rigidity roller having a surface coated with ceramic particles and a follower roller including an elastic roller having a surface coated with a low friction material. A sheet of printing medium is nipped and fed by the drive roller and the transporting roller.

12 Claims, 6 Drawing Sheets

SHEET TRANSPORTING DEVICE

BACKGROUND OF THE INVENTION

1. Field of the Invention

This invention relates to a sheet transporting device for transporting a sheet of printing medium, such as regular paper, coated paper, overhead projector sheet, glossy paper, and glossy film. More specifically, such a sheet transporting device may be used for a printer.

Generally, known sheet transporting devices use a pair of rubber rollers, where one of the paired rollers is a drive roller and the other is a follower roller. This arrangement causes a number of problems with sheet transporting accuracy, especially if the drive roller is formed with a rubber roller. First, it is difficult to produce a rubber roller with an accurately dimensioned outside diameter. Second, rubber rollers wear quickly and the thermal expansion of the roller is large. Finally, the coefficient of friction of the roller may be markedly reduced by paper powder, dust and chemicals of coated paper, which attach to the surface of the roller.

A sheet transporting device that attempted to solve the above problems is disclosed in Unexamined Japanese Patent Application No. Hei. 4-140247. In this sheet transporting device, the drive roller is a metal roller with a surface that has been subjected to a blasting process and has a highly accurate outside diameter, and the follower roller is an elastic roller, the surface of which is coated with silicon. According to such a sheet transporting device, because the friction coefficient of the elastic roller is small, the roller pair exhibits a low resistance to paper transportation, and further, the use of the rigid roller blasting process ensures stable transportation of the printing medium.

This sheet transporting device, however, may suffer from other disadvantages. For example, during the blasting process, the raised edges or peaks of the irregular surface of the metal drive roller are easily plastically deformed. As a result, when the printing medium is a film, the coefficient of friction of the paired rollers is insufficient, and transporting accuracy is decreased. Additionally, the paired rollers are easily worn, and, hence, their durability is low.

As such, there is a need for a sheet transporting device that is durable, and accurately and reliably feeds printing media, including media such as films.

SUMMARY OF THE INVENTION

Generally, in accordance with the invention, a sheet transporting device includes a drive roller of a high rigidity material that has a surface coated with ceramic particles to create an irregular drive roller surface. A transporting or follower roller made of an elastic material that has a surface coated with a low friction material. The follower roller acts with the drive roller to feed a sheet of printing media when it is positioned between the follower roller and the drive roller.

According to the sheet transporting device, even if the printing medium transported by the paired rollers is a film, the roller pair has a coefficient of friction sufficient to reliably feed the film because of the irregular surface of the drive roller due to the ceramic particles. Therefore, the sheet transporting device accurately transports printing medium, even if it is a film. Further, since the peaks of the drive roller surface are irregular due to the ceramic powdery particles, and these particles are not easily deformed, the roller pair is durable.

Moreover, the drive roller according to the invention is easily manufactured. The drive roller is formed by spraying a coating containing ceramic powdery particles directly onto the surface of a high rigidity roller, and the sprayed coating is permitted to dry. Because the ceramic powdery particles are made of alumina or silicon carbide, the cost to manufacture the drive roller is low.

One potential problem with using ceramic particles is that an appropriate size particle must be chosen. If the average diameter of the ceramic powdery particles is greater than 70 $\mu$m, the sheet is easily scratched. If the average diameter of the ceramic particles is less than 20 $\mu$m, the irregular surface of the drive roller is easily clogged with paper particles attached to the drive roller. As a result, sufficient friction coefficient cannot be obtained. Thus, according to the sheet transporting device of the invention, the average diameter of the ceramic powdery particles is preferably 20 $\mu$m to 70 $\mu$m. As such, the printing media is not scratched and the necessary friction coefficient is secured.

Another potential problem with using the ceramic particles is choosing an appropriate particle density. If the distribution density of the ceramic powdery particles is 80% or larger, the ceramic powdery particles are stratified or conglomerated and the resultant friction coefficient is insufficient. Conversely, if the density is 20% or smaller, the number of contacts of the raised edges or peaks of the irregular surface by the powdery particles with the sheet is reduced. The result is unstable sheet transportation. According to the sheet transporting device of the invention, the distribution density of the ceramic powdery particles on the surface of the high rigidity roller is preferably 20% to 80%. As such, the ceramic powdery particles are not stratified, and the necessary friction coefficient is maintained. Furthermore, a sufficient number of contacts of the peaks of the surface irregularity by the powdery particles with the sheet is secured. Accordingly, the transportation of the sheet is stable.

In the sheet transporting device, the follower roller includes a pair of rollers mounted on a shaft arranged in parallel with the axial line of the drive roller. The pair of rollers are mounted on the shaft while being disposed symmetrically with respect to a central portion of the shaft (when viewed in the axial direction of the axis). Both ends of the shaft are movable only toward the drive roller, and only the central portion of the shaft is urged toward the drive roller.

Further, in the sheet transporting device, one side of the printing medium is brought into contact with the transporting roller or follower roller, and the reverse side of the printing medium is brought into contact with the drive roller. Because either the roller pair or the follower roller are uniformly pressed against the drive roller, the printing medium is nipped and transported in a reliable manner.

To solve the aforementioned problem, an object of the present invention is to provide a sheet transporting device that can transport a printing medium, even if it is a film, accurately and with excellent durability.

Another object of the invention is to provide a sheet transporting device that has a low manufacturing cost, and is easy to manufacture.

Yet another object of the invention is to provide a sheet transporting device with a drive roller coated with a particle having an appropriate diameter and an appropriate density.

Another object of the invention is to provide a sheet transporting device whose transporting or follower roller whose alignment is maintained with the drive roller at all times.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
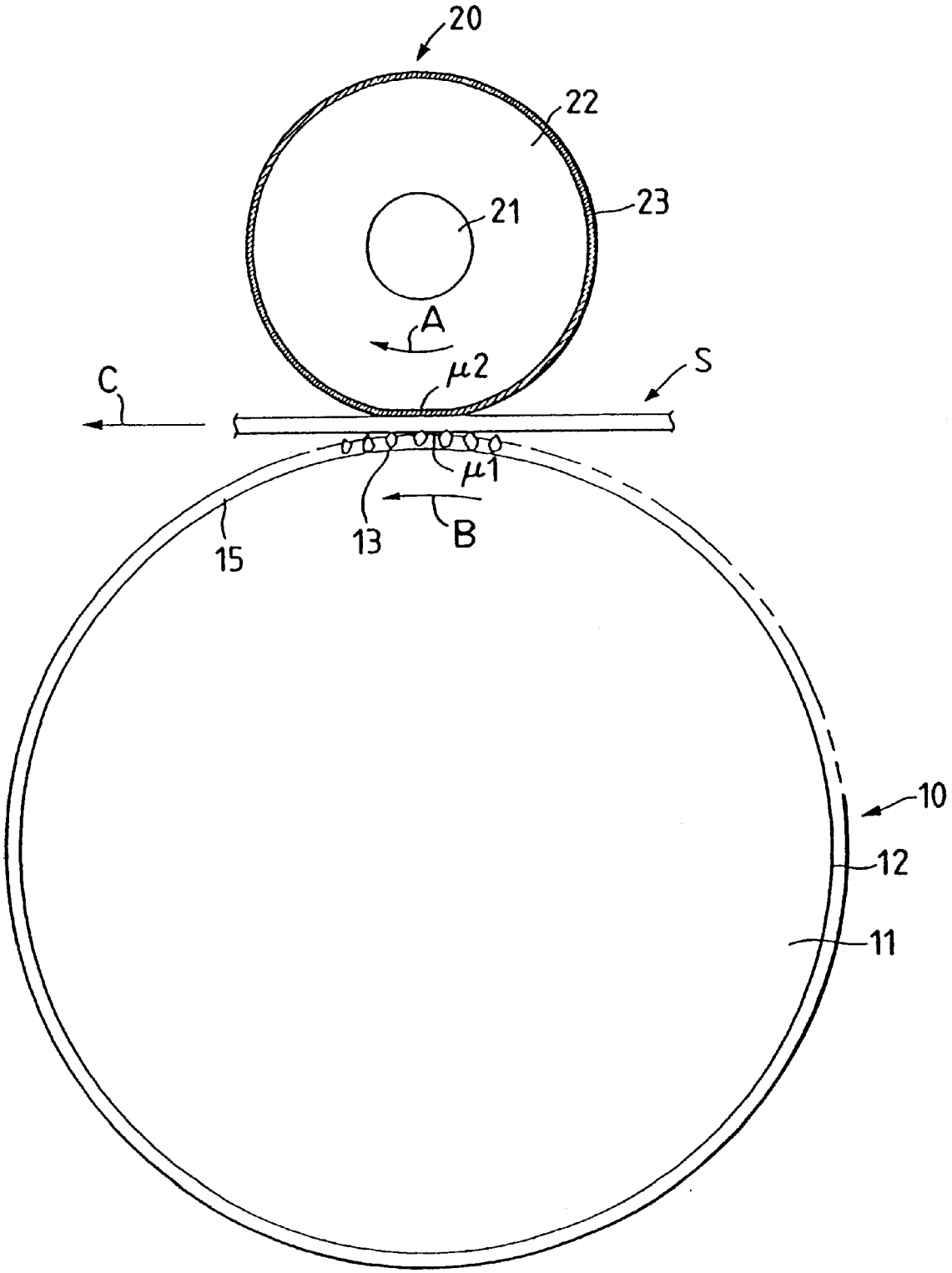
FIG. 1 is an enlarged cross-sectional view of a drive roller and transporting roller for a sheet transporting device according to the present invention.
Figure 2:
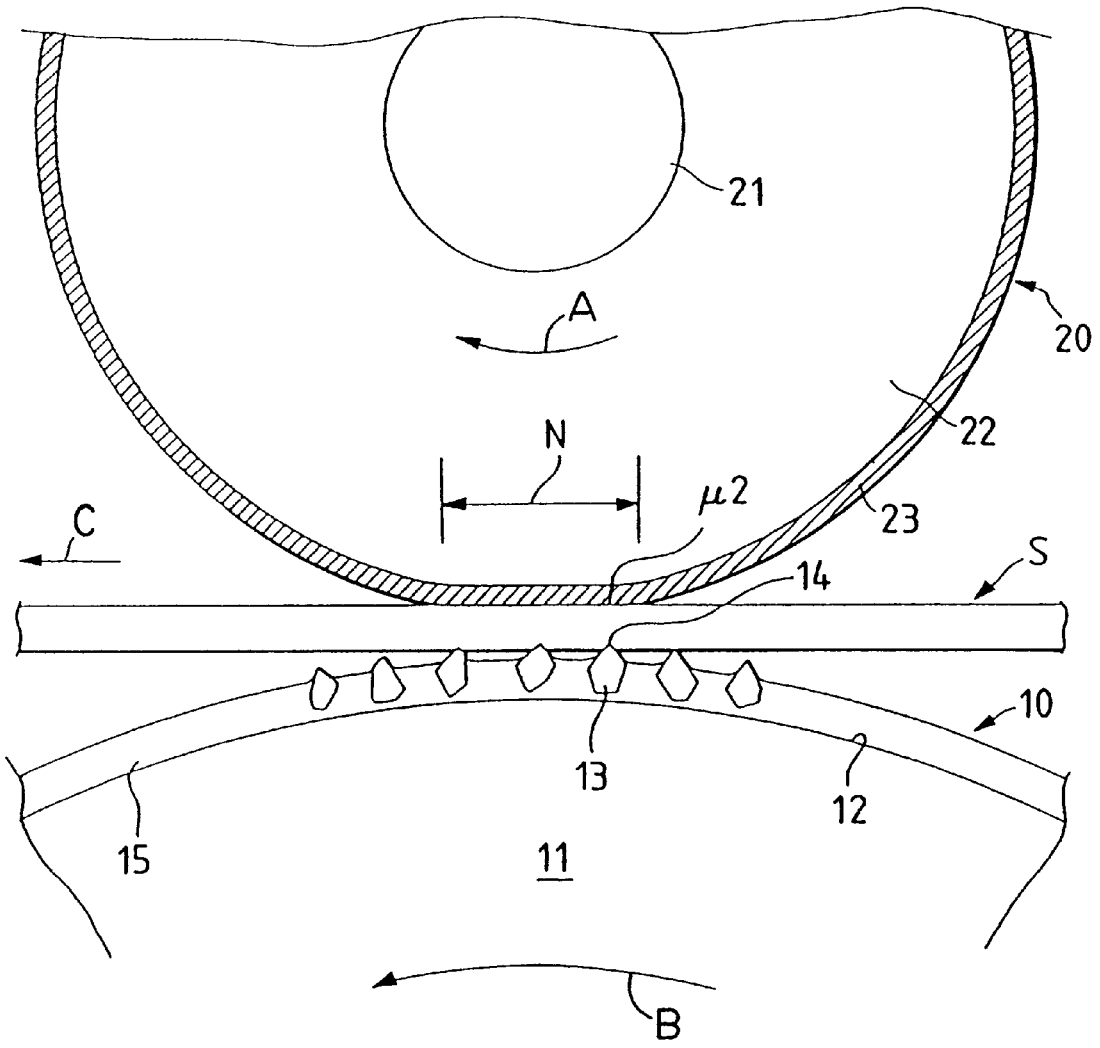
FIG. 2 is an enlarged view showing a portion of the sheet transporting device of FIG. 1.

Referring to FIGS. 1 and 2, a sheet transporting system is represented that includes a drive roller 10, a transporting or follower roller 20 for transporting a sheet of printing medium S, which may consist of paper, for example. As shown in FIG. 1, follower roller 20 is driven in the direction of arrow A, and is urged toward drive roller 10 by an urging means (not shown) such that follower roller 20 is pressed against drive roller 10 and rotates when drive roller 10 rotates. Therefore, when sheet S is fed to between drive roller 10 and roller 20, drive roller 10 is rotated in the counter-clockwise direction, shown as arrow B, follower roller rotates in the clockwise direction, shown as arrow A, and sheet S is transported while being nipped between those rollers in a sheet feed direction C.

Drive roller 10 includes a roller of high rigidity 11 (e.g., a metal roller) having a surface 12 coated with a coating 15 that contains ceramic particles 13. As shown in FIG. 2, because particles 13 have raised edges 14, which are relatively jagged or acute, the surface of the drive roller 10 is irregular. Ceramic particles 13 may be powdery particles of alumina ($AL_2O_3$) or silicon carbide (SiC). The average diameter of ceramic particles 13 is preferably about 20 $\mu$m to 70 $\mu$m. More preferably, the average diameter of ceramic particles 13 is preferably 25 $\mu$m to 70 $\mu$m. A distribution density of ceramic particles 13 on the area of the surface 12 of high rigidity roller 11 is preferably about 20% to 80%.

Drive roller 10 has a friction coefficient $\mu l$, which depends on the type of paper being transported. When transporting plain paper, friction coefficient $\mu l$ is equal to or greater than 0.65; when transporting film paper, friction coefficient $\mu l$ is equal to or greater than 0.60. Drive roller 10 is manufactured such that coating 15 containing ceramic particles 13 is directly sprayed on surface 12 of high rigidity roller 11, and then, coating 15 is dried. Coating 15 may contain acrylic resin as a major component.

Transporting or follower roller 20 is formed such that a coating layer 23, made of low friction material, is formed over the surface of an elastic roller 22. Elastic roller 22 may be, for example, a rubber roller. In a preferred embodiment, coating layer 23 is a fluorine coating.

Preferably, the hardness of elastic roller 22 is about 60° to 95° in rubber hardness. If the hardness of elastic roller 22 is high (in excess of 95°), when follower roller 20 is pressed against drive roller 10, the width (i.e., the length extending in the sheet transporting direction) of a support part or nip N of follower roller 20 for sheet S is insufficient, and sheet transportation is unstable. If the hardness of the roller 22 is low (60° or less), follower roller 20 is excessively deformed, and contact of sheet S with nip N is unstable. Accordingly, the hardness of elastic roller 22 is preferably about 60° to 95° in rubber hardness.

Preferably, coating layer 23 of elastic roller 22 is about 50 $\mu$m to 20 $\mu$m in thickness. If coating layer 23 is too thick (in excess of 20 $\mu$m), a smooth elastic deformation of elastic roller 22, is hindered. Conversely, if layer 23 is too thin (thinner than 5 $\mu$m), it is impossible to reduce a friction coefficient $\mu 2$ of follower roller 20 against sheet S. If friction coefficient $\mu 2$ is large, when the leading edge of sheet S enters nip N, the leading edge will be turned up, as the leading edge passes through nip N.

Further, in the skewing operation of sheets, the leading edge of the sheet S sometimes will be folded. More specifically, in the skewing operation, the leading edge of sheet S passes through nip N, and, then, drive roller 10 and follower roller 20 are reversely turned until the leading edge of sheet S is moved in a reverse sheet feed direction and passes through the nip N. At that point, drive roller 10 is rotated in direction B, thereby turning follower roller 20 in direction A, and transporting sheet S is moved in the sheet feed direction. If the coefficient of friction $\mu 2$ is too large, the leading edge of sheet S will be turned up and folded. A proper value of friction coefficient $\mu 2$ is 0.30 or less. To attain this value, the thickness of coating layer 23 is preferably set at 5 $\mu$m or thicker.

Where elastic roller 22 is formed with a rubber roller, a problem may occur due to the plasticizer contained within the rubber. If this plasticizer is eluted from the surface of follower roller 20, the eluted plasticizer may attach to the surface of sheet S (e.g., a coated sheet). Accordingly, the diameter of the printed ink dot may be reduced. Further, a roller trace scar may appear on sheet S due to the boundary between a portion having the eluted plasticizer and a portion not having the eluted plasticizer. Furthermore, if the plasticizer is attached to coating 15 of drive roller 10, coating 15 may be dissolved due to a reaction with the acrylic resin of coating 15. These problems, however, can be solved by having the thickness of coating layer 23 perferably be selected to be 5 $\mu$m or thicker to prevent the plasticizer from being eluted.

Figure 3:
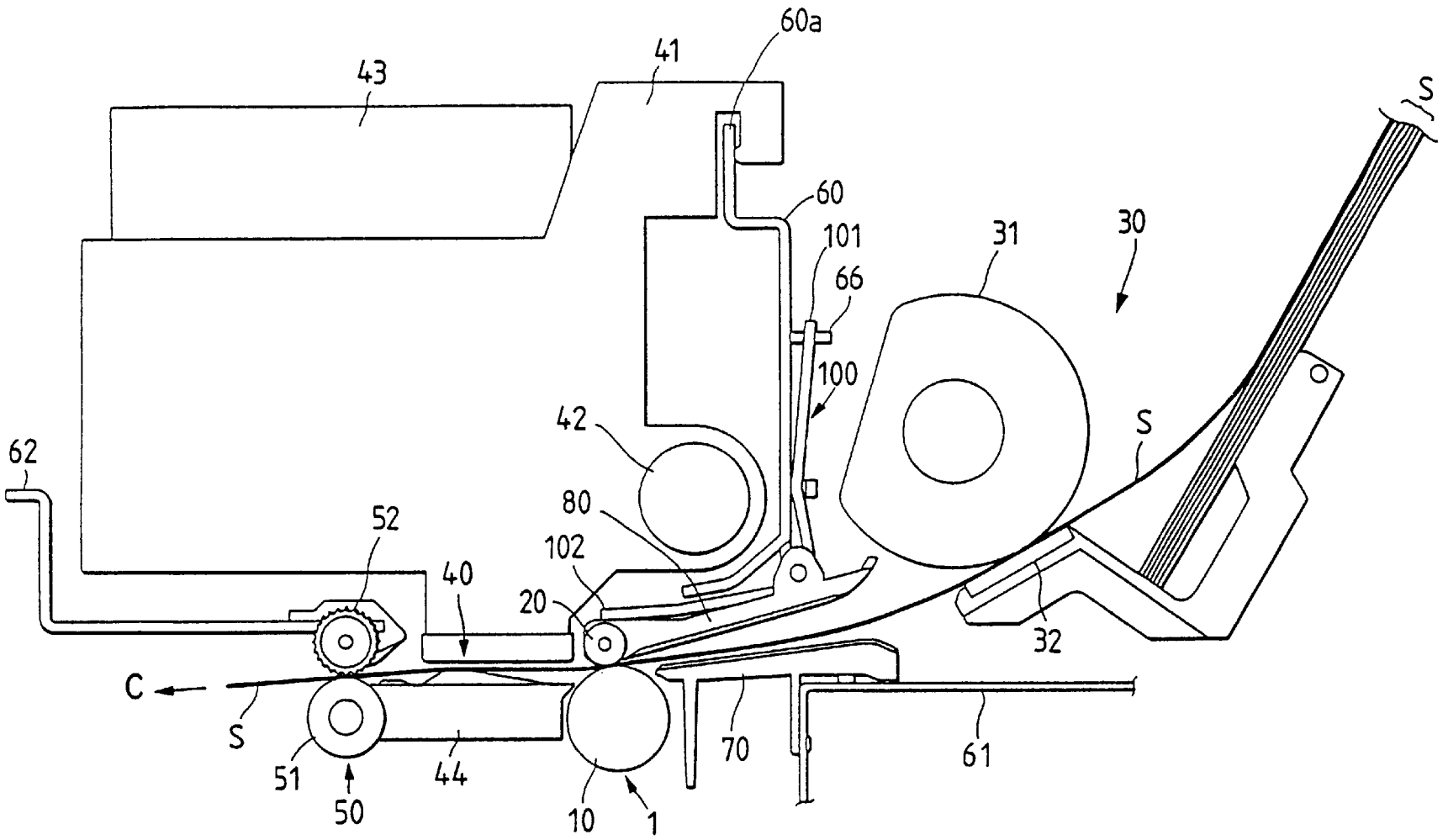
FIG. 3 is a side cross-sectional view of an ink jet printer using the sheet transporting device in accordance with the invention.

FIG. 3 is a side cross-sectional view showing an ink jet printer using the sheet transporting device of the invention. This ink jet printer includes a sheet transporting device 1, a sheet supplying device 30 supplying sheet S to sheet transporting device 1, a printing head 40 for jetting ink droplets onto the surface of the sheet S being transported by sheet transporting device 1 to thereby form an image (including characters), and a discharge roller pair 50 for discharging printed sheet S. The printer further includes a main frame 60, upon which the above components are mounted, a first sub-frame 61, a second sub-frame 62, a pair of side frames (not shown), and the like.

Sheet transporting device 1 is constructed such that drive roller 10 is supported by a side frame (not shown) and driven by appropriate drive means (not shown). Follower roller 20 is supported by a support structure (described below) and is turnable by means of its contact with drive roller 10.

Sheet supplying device 30 includes a supply roller 31, a hopper (not shown) for urging sheet S toward supply roller 31, and a separation pad 32, which associates with supply roller 31 to nip sheet S therebetween and separates an individual sheet S from a stack of sheets S in the hopper. In supplying sheets, the hopper presses stacked sheets against supply roller 31, which in conjunction with separation pad 32 separates a sheet S from the stacked sheets by rotating one turn. In this manner, sheet S is fed toward sheet transporting device 1. Sheet S is then guided to sheet transporting device 1 by a lower guide 70 mounted on first sub-frame 61 and an upper guide 80 mounted on main frame 60.

Printing head 40 is mounted on a carriage 41, which is movable in the direction orthogonal to the sheet feed direction. Top end 60*a* of main frame 60 and a carriage guide 42 guide carriage 41. An ink tank 43 is carried on carriage 41.

To print according to the invention, printing head 40 jets ink droplets onto sheet S of printing medium to print one line while carriage 41 is moved in the direction orthogonal to the sheet feed direction. As each line is printed, sheet S is fed at a preset pitch (usually a space between the adjacent lines) by sheet transporting device 1. The sequence of operations is repeated to print on the full page of sheet S. Guide 44 guides sheet S by supporting the underside of sheet S and thereby defines a space between sheet S and printing head 40.

Discharge roller pair 50 includes a drive roller 51 and a follower star wheel 52, which is urged toward drive roller 51. The follower star wheel 52 is mounted on sub-frame 62. Discharge roller pair 50 receives sheet S after it is printed upon and discharges sheet S to a paper tray (not shown).

Figure 4:
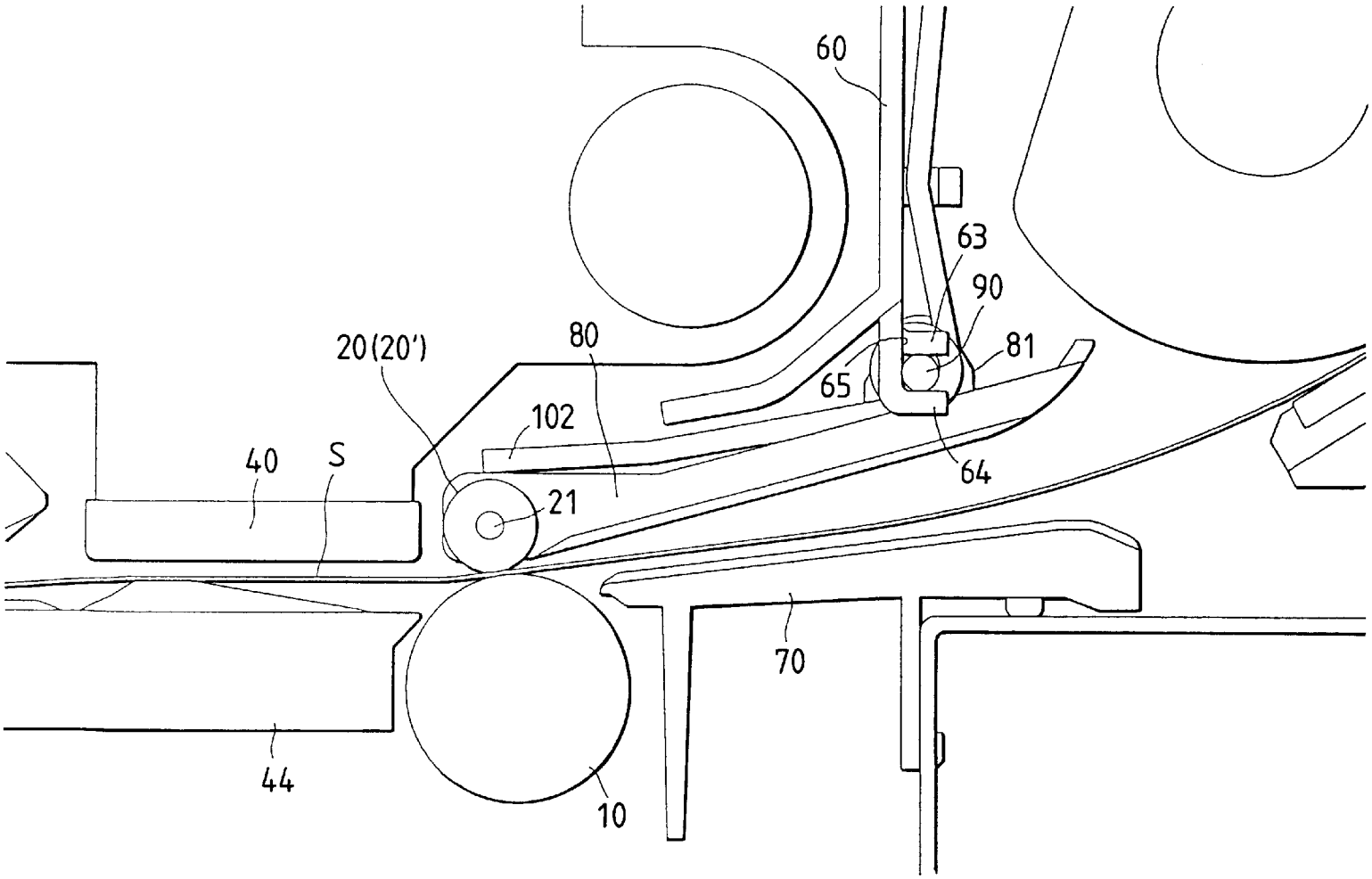
FIG. 4 is an enlarged side view showing a portion of the sheet transporting device of FIG. 3.

Follower roller 20 of sheet transporting device 1 will now be described with reference to FIGS. 3 through 5. As is shown in the figures, follower roller 20 is rotatably mounted on an upper guide 80. Upper guide 80 is plate-like in shape, and includes a base 81, which is rotatably mounted on a support shaft 90. Support shaft 90, as shown in FIG. 4, is supported by hook portions 63 and 64, which are bent at the lower end of main frame 60. Also, as shown in FIG. 4, the ends of the support shaft 90 are in contact with a rear side 65 (the right-side surface in FIG. 4) of main frame 60. Therefore, support shaft 90 is arranged in parallel with the axial line of drive roller 10 of sheet transporting device 1.

Figure 5:
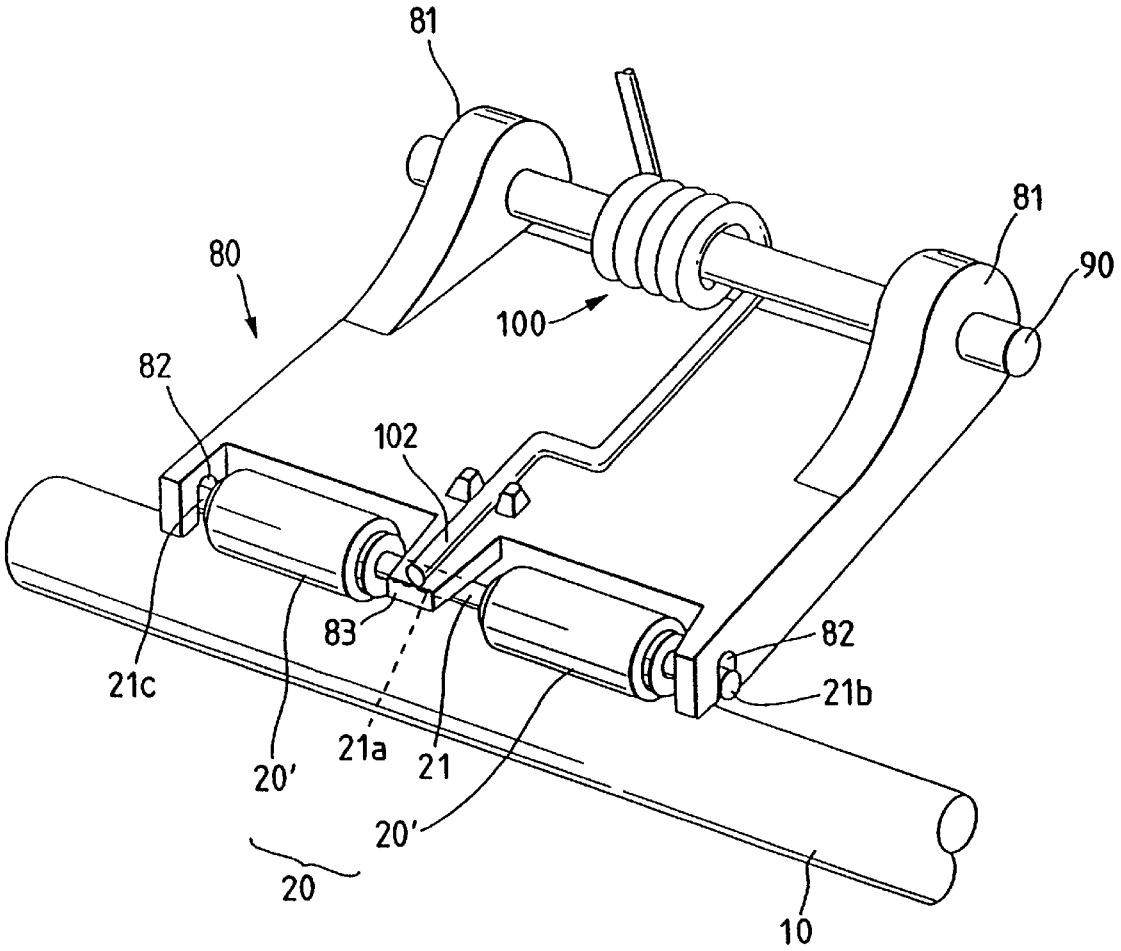
FIG. 5 is a perspective view showing a supporting structure for supporting the transporting roller in accordance with the invention.

As shown in FIG. 5, follower roller 20 includes a single shaft 21 and two rollers 20', which are rotatably mounted on shaft 21. Rollers 20' are arranged symmetrically with respect to a central portion 21*a* of shaft 21, and are not arranged on central portion 21*a*. Elongated holes 82, formed in opposed sides of guide 80, are elongated in the vertical direction perpendicular to the sheet feed direction, and support respective ends 21*b* and 21*c* of shaft 21. A pushing part 83 of guide 80, which contacts central portion 21*a* of shaft 21, is formed at the distal end of upper guide 80. Elongated holes 82 and 82 are equidistant from base 81 and support shaft 90.

A torsion spring 100 is wound about support shaft 90. One end 101 of torsion spring 100, as shown in FIG. 3, is hooked at a hook portion 66 of main frame 60. The other end 102 of spring 100 is brought into contact with pushing part 83 of upper guide 80 to urge upper guide 80 toward drive roller 10. Ends 21*b* and 21*c* of shaft 21 are supported so as to allow both ends 21*b* and 21*c* to be movable only toward drive roller 10. Only central portion 21*a* of shaft 21 is urged toward drive roller 10. Therefore, shaft 21 is swingably movable about its central portion 21*a* (when viewed from the front), independently of support shaft 90, and shaft 21 is pressed against and along drive roller 10.

Elongated holes 82, which support ends 21*b* and 21*c* of shaft 21, are located equidistant from support shaft 90. Therefore, shaft 21 and shaft 90 are parallel to each other. Support shaft 90 is pressed against rear side 65 of main frame 60 by means of torsion spring 100. Parallelism between support shaft 90 and drive roller 10 is accurately maintained so that shaft 21 of follower roller 20 and the axial line of drive roller 10 is also maintained in parallel. In particular, shaft 21 of follower roller 20 is swingably movable about central portion 21*a* (when viewed from the front side) independently of support shaft 90. Because of this, the parallelism of shaft 21, when viewed from the front side is maintained extremely accurately. Where a parallel condition of shaft 21 of follower roller 20 and the axial line of drive roller 20 is insufficient, follower roller 20 is also swingably movable in a direction perpendicular to the axial line of drive roller 10 as pushing part 83 of upper guide 80 is abutingly maintained against central portion 21*a* of shaft 21. Thus, an automatic shaft adjusting mechanism is constructed, and rollers 20' are uniformly pressed against drive roller 10.

Ends 21*b* and 21*c* of follower roller 20 are supported so as to allow both ends 21*b* and 21*c* of follower roller 20 to be movable only toward drive roller 10. Only central portion 21*a* of shaft 21 is urged toward drive roller 10. Therefore, shaft 21 is uniformly pressed against and along drive roller 10. In the printer, follower roller 20, or the plurality of the follower rollers 20', thus are supported parallel to drive roller 10 in its axial direction.

Sheet transporting device 1 thus constructed has the following useful effects.

Sheet transporting device 1 thus constructed has the following useful effects.

a) Drive roller 10 includes high rigidity roller 11 formed such that surface 12 of roller 11 is coated with ceramic powdery particles 13 and hence irregular. Follower roller 20, which associates with drive roller 10 to nip and transport sheet S, includes elastic roller 22 formed such that coating layer 23 of low friction material is layered over the surface of elastic roller 22 to form follower roller 20. Therefore, even if sheet S is a film, a sufficient friction coefficient $\mu 1$ (FIG. 1) of the roller pair (follower roller 20 and drive roller 10) against the film is secured because of the presence of the irregularly shaped ceramic particles 13.

In sum, sheet transporting device 1 of the invention can highly accurately transport sheet S of printing medium, even if it is a film. Further, the irregularity of ceramic powdery particles 13 is negligibly plastically deformed. In this respect, drive roller 10 has a high durability.

b) Drive roller 10 is manufactured using a simple manufacturing method. Coating 15, which contains ceramic powdery particles 13, is directly sprayed onto surface 12 of high rigidity roller 11, and the sprayed coating is permitted to dry.

c) The manufacturing cost of drive roller 10 is low as ceramic powdery particles 13 may be alumina or silicon carbide, which are low in cost.

d) The diameter of ceramic particles 13 is preferably 20 $\mu$m to 70 $\mu$m. Therefore, drive roller 10 has the following useful effect. If the diameter of the ceramic powdery particles 13 is too large (particle 13 average diameter is 70 μm or larger), sheet S is easily scratched. If the diameter is too small (particle 13 average diameter is 20 μm or shorter), the irregular surface of drive roller 10 is easily clogged with paper particles attached to drive roller 10.

As such, sufficient friction coefficient μ1 cannot be obtained. On the other hand, in sheet transporting device 1, the average diameter of the ceramic particles 13 is preferably 20 μm to 70 μm as referred to above. Therefore, sheet S is negligibly scratched and the necessary friction coefficient μ1 is maintained.

e) The distribution density of ceramic particles 13 on surface 12 of high rigidity roller 11 is preferably 20% to 80%. As such, the following useful effect is obtained. If the distribution density of ceramic particles 13 is too large (80% or larger), particles 13 are stratified (conglomerated) and the resultant friction coefficient μ1 has an insufficient value. Conversely, if the density is too small (20% or smaller), the number of contacts of the raised edges or peaks (indicated by numeral 14 in FIG. 2) of the irregular surface by particles 13 with sheet S is reduced. The result is an unstable transportation of sheet S.

In sheet transporting device 1, the distribution density of ceramic powdery particles 13 on surface 12 of high rigidity roller 11 is preferably 20% to 80%. Therefore, ceramic powdery particles 13 are not stratified, and the necessary friction coefficient μ1 is secured. Further, a sufficient number of contacts of the peaks of the surface irregularity by the powdery particles with sheet S is secured. Accordingly, the transportation of sheet S is stable.

f) Follower roller 20 includes shaft 21 arranged in parallel with the axial line of drive roller 10 and roller pairs 20', which are mounted on shaft 21 while being located on either side of central portion 21*a* of shaft 21. Both ends 21*b* and 21*c* of shaft 21 are movable only toward drive roller 10. Only central portion 21*a* of shaft 21 is urged toward drive roller 10. Therefore, roller pair 20', or follower roller 20, are uniformly pushed against drive roller 10 thereby reliably transporting sheet S, in a sheet feed direction.

This useful effect is now described with reference to FIGS. 6(*a*) and 6(*b*), in which models of the load exerted on sheet S by follower roller 20 and drive roller 10 are illustrated.

Figure 6A:
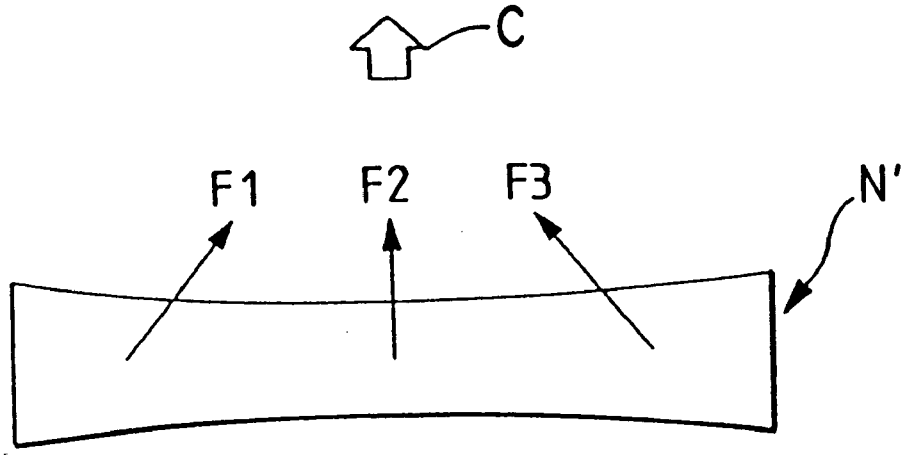
FIG. 6(a) PRIOR ART
FIGS. 6(*a*) and 6(*b*) are explanatory diagrams for explaining the sheet transporting operation of a conventional sheet transporting device and the sheet transporting device of the invention.
Figure 6B:
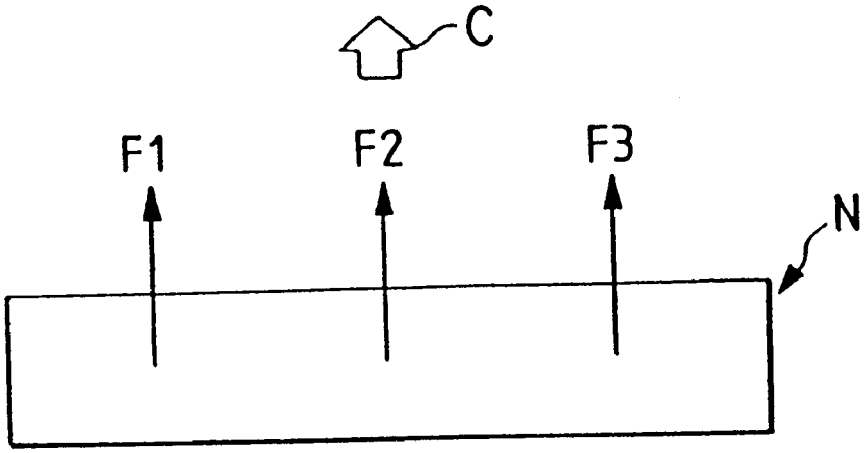

FIG. 6(*a*) is a plan view showing nip N of the paired rubber rollers in a conventional general sheet transporting device of the prior art. In FIG. 6(*a*), an arrow C indicates a sheet feed direction. In this conventional sheet transporting device, the press force between the paired rollers is not always uniform. If contact is not uniform, a contact portion, or a nip N, of the paired rollers is deformed from its rectangular shape. Under this condition, transporting force vectors F1, F2 and F3, which represent forces exerted on the sheet by the paired rollers, are not parallel to one another. However, a slipping phenomenon occurs between the sheet and the roller pair. Therefore, the sheet is not wrinkled or skewed.

Where the friction coefficient is increased to be large between drive roller 10 and sheet S, and transporting force vectors F1, F2 and F3 are not maintained in parallel, it is difficult for slip to occur between drive roller 10 and sheet S due to the higher friction coefficient. As a result, sheet S is wrinkled and skewed.

In connection with this fact, it is noted that, in sheet transporting device 1 of the invention, following roller 20 is parallel to drive roller 10, and follower roller 20 is pressed against drive roller 10 by a uniform load. Under this condition, nip N is rectangular in shape and, as such, transporting force vectors F1, F2 and F3 are maintained in parallel. As such, sheet S is not wrinkled, and is fed straightforward in the sheet feed direction.

While the present invention has been described in a specific form, it should be understood that the invention is not limited to the above-mentioned embodiment, but may variously be modified, altered and changed.

For example, follower roller 20 may be constructed as the drive roller. Besides, it is evident that the sheet transporting device of the invention is applicable to any of other suitable machines than the printer, for example, copying machines and facsimiles.

It will thus be seen that the objects set forth above, among those made apparent from the preceding description, are efficiently attained and, since certain changes may be made in carrying out the above apparatus without departing from the spirit and scope of the invention, it is intended that all matter contained in the above description shall be interpreted as illustrative and not in a limiting way.

It is also to be understood that the following claims are intended to cover all of the generic and specific features of the invention herein described and all statements of the scope of the invention which, as a matter of language, might be said to fall therebetween.

What is claimed is:

1. A sheet transporting device, comprising:

a drive roller including a highly rigid roller having a first surface, and a coating on said first surface, said coating having ceramic particles formed with raised edges therein, wherein said coating is applied to said first surface by spraying with said ceramic particles being mixed therein; and a follower roller having a second surface, said second surface coated with a low friction material, said follower roller acting with said drive roller to feed printing media while the printing medium is disposed between said follower roller and said drive roller.

2. The sheet transporting device of claim 1, wherein the follower roller includes an elastic roller portion upon which said low friction material is applied.

3. The sheet transporting device of claim 1, wherein said ceramic particles are selected from the group consisting of alumina particles and silicon carbide particles.

4. The sheet transporting device of claim 1, wherein an average diameter of said ceramic particles is substantially 20 μm to 70 μm.

5. The sheet transporting device of claim 1, wherein the distribution density of said ceramic particles on said first surface of said highly rigid roller is substantially 20% to 80%.

6. The sheet transporting device of claim 1, wherein said follower roller is a first follower roller, and wherein said sheet transporting device further comprises:

a guide;

a shaft, having a first end, a second end and a central portion, said shaft arranged in parallel with an axial line of said drive roller; and a second follower roller, said first and second follower rollers being rotatably mounted on said shaft and separated by said central portion of said shaft; said first end and said second end of said shaft being disposed within said guide and arranged to be movable toward said drive roller; said central portion of said shaft being urged toward said drive roller.

7. The sheet transporting device of claim 6, wherein said guide contacts said central portion of said shaft, and wherein said sheet transporting device further comprises a biasing means for biasing said guide toward said shaft.

8. The sheet transporting device of claim 1, wherein the printing medium has a top side and a bottom side, and said top side is brought into contact with said follower roller, and said bottom side is brought into contact with said drive roller so that the printing medium is nipped and transported in a sheet feed direction.

9. A method for forming a sheet transporting device for transporting printing media in a sheet feed direction, said method comprising the steps of:

providing a drive roller having a first surface;

spraying a coating onto said first surface, said coating having ceramic particles with raised edges mixed therein;

permitting said sprayed coating to dry;

providing a follower roller having a second surface coated with a low friction material; and, then, arranging said follower roller to act with said drive roller to nip the printing media and transport it in the sheet feed direction.

10. The method of claim 9, wherein said ceramic particles are selected from the group consisting of alumina particles and silicon carbide particles.

11. The method of claim 9, wherein an average diameter of said ceramic particles is substantially 20 $\mu$m to 70 $\mu$m.

12. The method of claim 9, wherein the distribution density of said ceramic particles on said first surface of said drive roller is substantially 20% to 80%.

* * * * *